United States Patent [19]

Ayers

[11] 3,974,025

[45]*Aug. 10, 1976

[54] ABSORBENT PAPER HAVING IMPRINTED THEREON A SEMI-TWILL, FABRIC KNUCKLE PATTERN PRIOR TO FINAL DRYING

[75] Inventor: Peter G. Ayers, West Chester, Ohio

[73] Assignee: The Procter & Gamble Company, Cincinnati, Ohio

[ * ] Notice: The portion of the term of this patent subsequent to Sept. 16, 1992, has been disclaimed.

[22] Filed: June 19, 1975

[21] Appl. No.: 588,580

Related U.S. Application Data

[60] Division of Ser. No. 457,043, April 1, 1974, Pat. No. 3,905,863, which is a continuation-in-part of Ser. No. 368,440, June 8, 1973, abandoned.

[52] U.S. Cl. ..... 162/113; 139/425 A; 156/183; 162/116; 162/117; 428/153

[51] Int. Cl.[2] ..... D21H 5/24; B31F 1/12

[58] Field of Search ..... 162/109, 111, 113, 116, 162/117; 139/425 A, 383 R; 156/183, 219, 220; 428/153, 156

[56] References Cited

UNITED STATES PATENTS

| | | | |
|---|---|---|---|
| 3,159,530 | 12/1964 | Heller et al. | 139/425 A X |
| 3,301,746 | 1/1967 | Sanford et al. | 162/113 |
| 3,473,576 | 10/1969 | Amneus | 139/425 A X |
| 3,573,164 | 3/1971 | Friedberg et al. | 139/383 R |
| 3,812,000 | 5/1974 | Salvucci et al. | 156/183 X |
| 3,817,827 | 6/1974 | Benz | 162/113 |
| 3,821,068 | 6/1974 | Shaw | 156/183 X |
| 3,851,681 | 12/1974 | Egan | 139/425 A X |
| 3,881,987 | 5/1975 | Benz | 162/116 |

*Primary Examiner*—S. Leon Bashore
*Assistant Examiner*—Arthur L. Corbin
*Attorney, Agent, or Firm*—E. Kelly Linman; Fredrick H. Braun; John V. Gorman

[57] ABSTRACT

A low-density, soft, bulky and absorbent paper sheet exhibiting a diamond-shaped pattern in its surface after creping, said paper being characterized by having a cross-directional stretch of from about 2 to about 6 percent, as well as improved softness, surface feel and drape, said paper sheet being particularly suitable for use in tissue, toweling and sanitary products. The aforesaid paper sheets are produced by impressing a dot-dash knuckle pattern, wherein the long axis of the dash impressions is aligned parallel to the machine direction of papermaking, using the back side of a monofilament, polymeric fiber, semi-twill fabric of selected coarseness, the knuckle imprint area of which constitutes between about 20 and about 50 percent of the total fabric surface area, as measured in the plane of the knuckles, on an uncompacted paper web at selected fiber consistencies, induced by thermal predrying, prior to final drying and creping.

4 Claims, 20 Drawing Figures

ABSORBENT PAPER HAVING IMPRINTED THEREON A SEMI-TWILL, FABRIC KNUCKLE PATTERN PRIOR TO FINAL DRYING

CROSS-REFERENCE TO RELATED APPLICATION

This is a division of application Ser. No. 457,043, filed Apr. 1, 1974, now U.S. Pat. No. 3,905,863, which is a continuation-in-part of my copending application Ser. No. 368,440, filed June 8, 1973, entitled "PROCESS FOR FORMING ABSORBENT PAPER BY IMPRINTING A SEMI-TWILL FABRIC KNUCKLE PATTERN THEREON PRIOR TO FINAL DRYING AND PAPER THEREOF," now abandoned.

FIELD OF THE INVENTION

This invention relates to improvements in papermaking and non-woven web manufacturing operations and particularly to the provision of a low-density, soft, bulky and absorbent paper sheet characterized by having significantly greater cross-directional stretch, as well as improved softness, surfaces feel and drape when compared to paper sheets produced by prior art papermaking and non-woven web manufacturing methods.

More particularly, in one important embodiment, the present invention consists of a monofilament, polymeric fiber, semi-twill fabric which when used to imprint an uncompacted paper web at selected fiber consistencies, induced by thermal pre-drying, will produce a dot-dash pattern wherein the long axis of the dash impressions is aligned parallel to the machine direction of papermaking and the long axis of the dot impressions is aligned parallel to the cross-machine direction. The aforesaid imprinting fabric is especially suitable for use in papermaking and non-woven web manufacturing operations, such as the papermaking operation disclosed in U.S. Pat. No. 3,301,746, issued to Sanford et al. on Jan. 31, 1967, said patent being incorporated herein by reference, wherein the surface characteristics of such fabrics are of operational and product characteristic importance.

In one preferred embodiment, the present invention consists of a monofilament, polymeric fiber, semi-twill fabric of the type normally used for transporting a moist web through the forming, pressing and drying sections of a papermaking machine, which monofilament, polymeric fiber, semi-twill fabric is woven and thereafter shrunk by heat treatment to result in a dimensionally heat stable fabric having uniform knuckle heights in conjunction with minimum "free" or interstitial area on the surface of the fabric which will contact the uncompacted paper web, said fabric having been further improved by abrading its web contacting surface with a fine abrasive medium to increase its knuckle imprint area.

BACKGROUND OF THE INVENTION

In a Fourdrinier paper machine, paper stock is fed onto a traveling endless belt that is supported and driven by rolls associated with the machine and which serves as the papermaking surface of the machine. Fourdrinier belts are commonly formed from a length of woven Fourdrinier fabric with its ends joined together in a seam to provide an endless belt. Fourdrinier fabrics of this type generally comprise a plurality of spaced longitudinal warp filaments and a plurality of spaced transverse woof or weft filaments which have been woven together on a suitable loom. It should be noted that the warp filaments of the fabric are, for purposes of this specification, defined as those which run parallel to the machine direction of papermaking and non-woven web manufacturing machines to form a continuous carrier belt; woof or weft filaments are, for purposes of this specification, defined as those which run in the cross-machine direction.

Although the weaving and fabric treatment criteria of the present invention are applicable in other areas of monofilament, polymeric fiber fabric use, the instant features will be most readily understood in respect to the use of such fabrics for imprinting purposes in web formation operations. In these operations, for example in the operation of a paper machine according to the teachings of U.S. Pat. No. 3,301,746, improved web transferability and dryer surface contact are desirable in an imprinting fabric, and the monofilament, polymeric fiber fabric used should not contribute factors to the final paper product other than those desired by the papermaker and designed into the paper product.

In referring to monofilament, polymeric fiber fabrics herein, applicant intends reference to moist web carrier fabrics woven, for example, from the polyamide fibers, vinyl fibers, acrylic fibers and polyester fibers sold under the respective trade names of "nylon," "Saran," "Orlon," "Dacron," and "Treviera." While both wrap and woof filaments in fabrics can be made up of a multiplicity of fibers, the present invention is concerned with warp and woof filaments comprised of one fiber, i.e., monofilaments.

While a number of different weaves have been proposed for Fourdrinier fabrics, two such weaves which find extensive use today are the so-called "plain" weave and the "semi-twill" (sometimes also called "long crimp") weave. In the plain weave, each weft filament passes successively under one warp filament and then over the next warp filament, whereas in the semi-twill weave each weft filament passes over two warp filaments, under the next warp filament, and then over the next two warp filaments in a repeated pattern. Of these two weaves, the semi-twill weave is the most widely used.

The imprinting fabric suggested for use in U.S. Pat. No. 3,301,746, to which the present invention has particular relevance, may be of square or diagonal weave, and can be of any specific construction including, for example, plain or semi-twill weave. A preferred imprinting fabric, according to the teachings of the aforesaid Sanford et al. patent, has about 20 to about 60 meshes per inch and is formed from filaments having a diameter of from about 0.008 to about 0.02 inches.

Paper sheets produced in accordance with the teachings of U.S. Pat. No. 3,301,746 utilizing a monofilament, polymeric fiber, semi-twill imprinting fabric exhibit properties similar in most respects to paper sheets produced utilizing a plain weave imprinting fabric having filaments of approximately the same diameter when the semi-twill fabric is installed so that its conventional "face" side is used to imprint the uncompacted paper web. This is due to the fact that the conventional face side of the semi-twill fabric, assuming the fabric has uniform knuckle heights on its web contacting side, will produce a dot-dash pattern wherein the long axis of the dash impressions is aligned parallel to the cross-machine direction and the long axis of the dot impressions is aligned parallel to the machine direction. The dash impressions result from each weft filament passing in a repeated pattern under one warp filament and then over the next two warp filaments, while the dot impressions result from each warp filament passing in a repeated pattern over one weft filament and then under the next two weft filaments on the conventional face side of the fabric.

When paper sheets imprinted by the conventional face side of a semi-twill fabric, as described above, are doctored from the drying drum, the dot-dash knuckle impressions are aligned essentially between the creping folds. The resulting creping folds are, therefore, substantially uninterrupted across the sheet's surface. Thus paper sheets produced utilizing the conventional face side of a semi-twill imprinting fabric exhibit properties substantially similar to paper sheets produced utilizing a plain weave imprinting fabric, i.e., a low-density, soft, bulky and absorbent paper sheet characterized by having uniform creping folds which extend substantially uninterrupted across the width of the sheet.

On the other hand, utilization of the "back" side of a monofilament polymeric fiber, semi-twill fabric to imprint an uncompacted paper web in accordance with the teachings of U.S. Pat. No. 3,301,746 will, assuming the fabric has uniform knuckle heights on its web contacting side, produce a dot-dash pattern wherein the long axis of the dash impressions is aligned parallel to the machine direction of the paper machine and the long axis of the dot impressions is aligned parallel to the cross-machine direction. The dash impressions result from each warp filament passing in a repeated pattern under one weft filament and then over the next two weft filaments, while the dot impressions result from each weft filament passing in a repeated pattern over one warp filament and then under the next two warp filaments on the back side of the fabric.

Paper sheets imprinted with the back side of a conventional semi-twill, monofilament, polymeric fiber fabric, unlike paper sheets imprinted with either a plain weave fabric or the conventional face side of a semi-twill fabric, exhibit a diamond-shaped pattern after creping.

Applicant has discovered that by increasing the knuckle imprint area on the back side of a conventional semi-twill, monofilament, polymeric fiber fabric in accordance with the teachings of U.S. Pat. No. 3,573,164 issued to Friedberg et al. on Mar. 30, 1971, said patent being incorporated herein by reference, unexpected improvements in paper sheet characteristics can be realized. These unexpected advantages take the form of improved cross-directional stretch, softness, surface feel and drape. The improvements become more pronounced as the knuckle imprint area on the back side of the semi-twill fabric is increased.

Although improved web transfer characteristics and improved drying of the web are realized when the web contacting knuckle surfaces of nearly any monofilament, polymeric fiber fabric are abraded in accordance with the teachings of U.S. Pat. No. 3,573,164, applicant has learned that the aforementioned improvements in cross-directional stretch, softness, surface feel and drape are realized only with respect to the back side of a semi-twill imprinting fabric, such as is described above.

In order to maximize the beneficial effects of abrading the knuckle surfaces on the back side of a semi-twill imprinting fabric, applicant has found it desirable to obtain a semi-twill fabric having uniform knuckle heights and minimum free area on its back side prior to initiating any abrading process. Uniform knuckle heights permit a greater increase in knuckle imprint area while minimizing the danger of abrading completely through any particular filament. In addition, if knuckle heights are uniform prior to initiating any abrading process, the resulting imprint pattern after abrading will be more uniformly consistent.

Because a fabric such as is utilized for imprinting purposes in U.S. Pat. No. 3,301,746 is subjected to elevated temperatures during use, it is desirable to dimensionally heat stabilize the fabric prior to subjecting it to an abrading process to increase its knuckle imprint area. If this is not done, the uniform imprinting surface produced by carefully weaving the fabric and abrading the web contacting surface of the fabric prior to use will tend to warp as the temperature of the fabric becomes elevated, thereby losing most of the benefits to be obtained by such careful pre-treatment.

A means of preparing a dimensionally heat stable, plain weave, monofilament, polymeric fiber fabric having uniform knuckle heights and minimum free area on each side of the fabric is disclosed in U.S. Pat. No. 3,473,576 issued to Amneus on Oct. 21, 1969, said patent being incorporated herein by reference. A plain weave fabric is prepared by selecting polymeric warp monofilaments having a relatively high heat-induced shrinkage potential and further selecting an initial warp monofilament spacing in the loom according to a mathematical equation disclosed in the aforementioned Amneus patent. Polymeric woof monofilaments are then selected which have a relatively low heat induced shrinkage potential, and these woof monofilaments are woven and beaten in the weaving process into a plain weave fabric having an initial caliper calculated according to yet another mathematical equation disclosed in the aforementioned Amneus patent. After the initial weaving process, the fabric knuckles are brought to uniform heights on both sides of the fabric and the minimum free area of the fabric is set by a heat shrinkage treatment which maintains the fabric in warp tension while allowing it to shrink in the woof direction. Successive heat treatments are repeated until the monofilament, polymeric fiber, plain weave fabric does not shrink further at the treating temperature, at which point it is said to be "locked-up", i.e., no further shrinkage will occur if the fabric is later subjected, in use, to elevated temperatures equivalent to the treating temperature.

It is important to note that due to the symmetry of the plain weave, uniform knuckle heights and minimum free area are achieved simultaneously on both sides of the fabric when the weaving and heat treatment processes described in the aforementioned Amneus Patent are utilized. This is not the case with a semi-twill weave fabric. If a monofilament, polymeric fiber, semi-twill fabric is subjected to a heat treatment process similar to that disclosed in the Amneus Patent, the knuckles on the conventional face side of the fabric will become coplanar before the knuckles on the back side of the fabric have reached a uniform height. Thus, in order for the knuckles on the back side of the fabric to become coplanar, the fabric must be subjected to further heat treatment. The additional heat treatment required to make the knuckle heights on the back side of the fabric uniform causes the knuckle heights on the conventional face side of the fabric to again become non-uniform.

Therefore, the initial warp filament spacing and caliper of a semi-twill fabric necessary to produce minimum free area and uniform knuckle heights on the back side of the fabric after heat treatment are determined experimentally by trial and error.

OBJECTS OF THE INVENTION

It is an object of the present invention to provide a low-density, bulky and absorbent creped paper structure exhibiting a diamond-shaped pattern in its surface, said paper structure having significantly improved softness, surface feel and drape, as well as significantly improved cross-directional stretch.

It is a further object of the present invention, in a preferred embodiment, to produce the above mentioned paper structure in accordance with the teachings of U.S. Pat. No. 3,301,746 by utilizing the back side of a conventional, monofilament, polymeric fiber, semi-twill fabric which has been abraded in accordance with the teachings of U.S. Pat. No. 3,573,164 to imprint the uncompacted paper web prior to creping.

It is a further object of the present invention, in a preferred embodiment, to produce a paper structure in accordance with the teachings of U.S. Pat. No. 3,301,746 wherein a dot-dash pattern is imprinted on the uncompacted paper web, prior to creping, such that the long axis of the dash impressions is aligned parallel to the machine direction and the long axis of the dot impressions is aligned parallel to the cross-machine direction.

It is another object of the present invention, in a preferred embodiment, to provide dimensionally heat stable, monofilament, polymeric fiber, semi-twill fabrics for use in fibrous web carrying, imprinting, and other fabric using operations, which monofilament, polymeric fiber, semi-twill fabrics are characterized by having uniform knuckle heights and minimum free area on their back side, thus contributing materially to the avoidance of transfer and contact problems in papermaking and web formation operations.

It is a further object of the present invention, in a preferred embodiment, to provide a process for the production of dimensionally heat stable, monofilament, polymeric fiber, semi-twill fabrics, which process sets criteria for the weaving and heat treating operations necessary to achieve uniform knuckle heights and minimum free area on the back side of said fabrics.

Another object of the present invention, in a preferred embodiment, is to provide a monofilament, polymeric fiber, semi-twill fabric for use in papermaking and non-woven web manufacturing operations, the back surface of which fabric has a total knuckle imprint area of from about 20 to about 50 percent of the total fabric surface area, as measured in the plane of the knuckles, and which knuckle imprint area has a surface finish at least equal in smoothness to the surface finish induced by abrasion with an abrasive medium having an effective abrasive grain size of less than about 300 mesh.

It is yet another object of the present invention, in a preferred embodiment, to provide a monofilament, polymeric fiber, semi-twill fabric for use in the imprinting and drying sections of a papermaking machine, the back side of which fabric presents an increased knuckle area to the moist paper web for use in pressing the web onto the surface of a dryer while it contributes materially to the final tensile strength of the dried paper product by avoiding the rupture of fiber bonds.

SUMMARY OF THE INVENTION

In a preferred embodiment of the present invention, a low density, soft, bulky and absorbent paper sheet is provided, said paper sheet exhibiting a diamond-shaped pattern in its surface after creping, said paper sheet being characterized by having a cross-directional stretch of from about 2 to about 6 percent, as well as improved softness, surface feel and drape, said paper sheet being particularly suitable for use in tissue, toweling, and sanitary products.

The soft, bulky and absorbent paper sheets of the present invention are produced, in a preferred embodiment, generally in accordance with the teachings of U.S. Pat. No. 3,301,746 by forming an uncompacted paper web, supporting said uncompacted paper web on the back side of a monofilament, polymeric fiber, semi-twill imprinting fabric having about 20 to about 60 meshes per inch, said imprinting fabric having been formed from filaments having a diameter of from about 0.008 to about 0.025 inches, the back side of said fabric having had its knuckle imprint area increased in accordance with the teachings of U.S. Pat. No. 3,573,164, thermally pre-drying said uncompacted paper web to a fiber consistency of about 30 to about 98 percent, imprinting a dot-dash knuckle pattern with the back side of said semi-twill imprinting fabric such that the long axis of the dash impressions in said pattern is aligned parallel to the machine direction and the long axis of the dot impressions is aligned parallel to the cross-machine direction of the pre-dried uncompacted paper web, and final drying and creping the paper sheet so formed.

In a preferred embodiment of the present invention, the back side of the monofilament, polymeric fiber, semi-twill imprinting fabric is prepared in accordance with the teachings of U.S. Pat. No. 3,573,164 by abrading the knuckle surfaces to increase the knuckle imprint area to between about 20 and about 50 percent of the total fabric surface area, as measured in the plane of the knuckles, as well as to polish the knuckle surfaces.

In yet another preferred embodiment of the present invention, the monofilament, polymeric fiber, semi-twill fabric is woven and heat treated so as to produce a dimensionally heat stable fabric having uniform knuckle heights and minimum free area on its back side prior to abrading the knuckle surfaces on the back side of the fabric.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings in which:

DESCRIPTION OF THE PREFERRED EMBODIMENTS

In describing preferred embodiments of the invention disclosed herein, specific terminology will be adhered to for the sake of clarity in referring to the features of the monofilament, polymeric fiber fabrics for use in papermaking and non-woven web manufacturing processes. The conventional face side of the semi-twill fabrics referred to herein refers to that side of the fabric which, according to the teachings of the prior art, would normally come in contact with the paper web, i.e., the side of the semi-twill fabric which would, depending upon its particular condition, produce one of the imprint patterns illustrated in FIGS. 4, 8 or 12 (assuming it is a right-hand semi-twill fabric). In the aforementioned Figures, the long axis of the dash impressions 9, where present, is aligned parallel to the cross-machine direction, while the long axis of the dot impressions 3, where present, is aligned parallel to the machine direction. The back side of the semi-twill fabrics referred to herein shall be defined as that side which would not normally contact the paper web according to the teachings of the prior art, i.e., the side of the semi-twill fabric which would, depending upon its particular condition, produce one of the imprint patterns illustrated in FIGS. 5, 9, 13, or 17 (assuming it is a right-hand semi-twill fabric). In the aforementioned figures, the long axis of the dash impressions 8 is aligned parallel to the machine direction, while the long axis of the dot impressions 10, where present, is aligned parallel to the cross-machine direction.

It should be noted that although a right-hand semi-twill fabric is utilized for purposes of illustration throughout this specification, the benefits disclosed can also be obtained utilizing a left-hand semi-twill fabric, which is woven as a mirror image of a right-hand semi-twill fabric.

Figure 1:
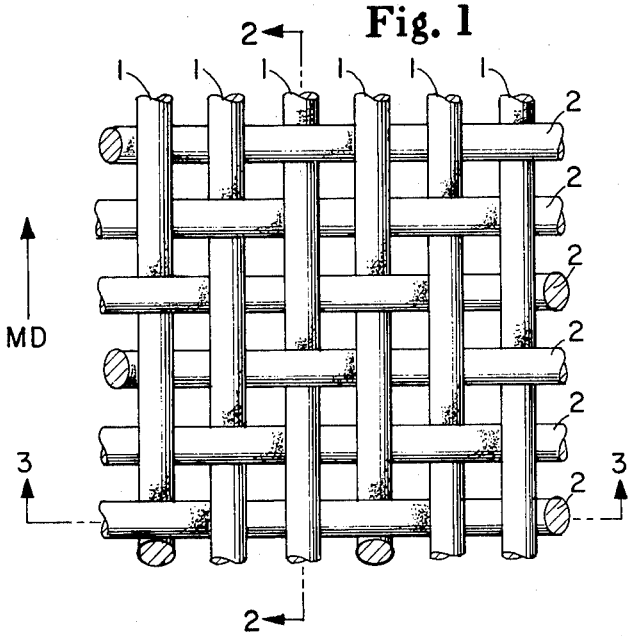
FIG. 1 is a plan view of an enlarged portion of a conventional right-hand semi-twill, monofilament, polymeric fiber fabric as viewed from the back side, i.e., that side of the fabric which according to the teachings of the prior art does not normally contact the web. The monofilament, polymeric fiber, semi-twill fabric is shown prior to any abrasion treatment and prior to use as an endless or continuous fabric belt in papermaking or non-woven web manufacturing operations.
Figure 2:
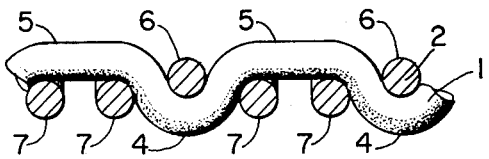
FIG. 2 is an enlarged cross-sectional view of the semi-twill fabric illustrated in FIG. 1, taken looking in the cross-machine direction (CD) along line 2—2 in FIG. 1, which cross-sectional view illustrates the higher relative elevation and the smooth knuckle surfaces of the warp filaments on each side of the fabric.
Figure 3:
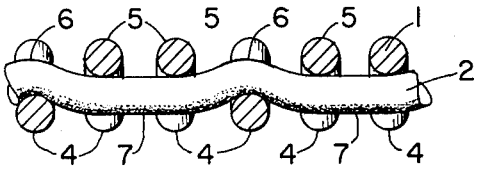
FIG. 3 is an enlarged cross-sectional view of the semi-twill fabric illustrated in FIGS. 1 and 2, taken looking in the machine direction (MD) along line 3—3 in FIG. 1, which cross-sectional view illustrates the lower relative elevation and the smooth knuckle surfaces of the woof or weft filaments.

FIG. 1 represents an enlarged plan view of a portion of a conventional right-hand, monofilament, polymeric fiber, semi-twill fabric as viewed from the back side. The semi-twill fabric illustrated in FIG. 1 has not been used on a paper machine nor has it been accorded any special abrading treatment. The warp monofilaments 1 are aligned parallel to the machine direction, while the woof or weft monofilaments 2 are aligned parallel to the cross-machine direction. In a preferred embodiment of the present invention, the imprinting fabric illustrated in FIG. 1 has about 20 to about 60 meshes per inch and is formed from monofilament polymeric fibers having diameters ranging from about 0.008 to about 0.025 inches. Both warp and woof monofilaments may, but need not necessarily be of the same diameter. FIGS. 2 and 3 are cross-sectional views of the semi-twill fabric illustrated in FIG. 1, taken looking respectively in the cross-machine and machine directions. The knuckles formed at the cross-over points of the warp filaments 1 and the woof filaments 2 are not coplanar on either the face or the back side of the fabric. As can be seen in FIGS. 2 and 3, the warp filaments 1 are at a higher relative elevation than the woof filaments 2 on both sides of the fabric. This is termed, for purposes of this specification, a "warp-high" condition of the fabric.

Figure 4:
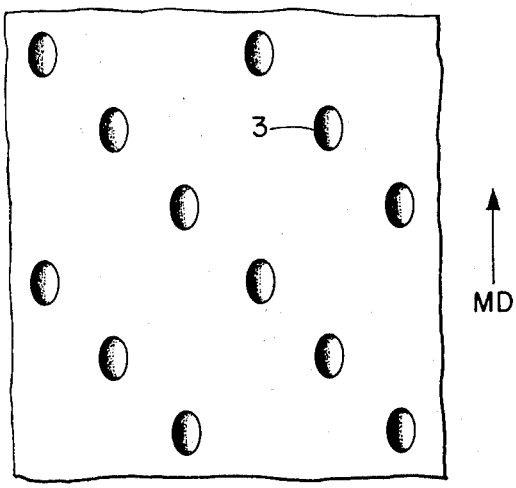
FIG. 4 is a simplified illustration of an enlarged partial plan view of an uncreped paper sheet which has been imprinted utilizing the conventional face side of a semi-twill fabric such as is shown in FIGS. 1 through 3. The long axis of the dot impressions formed by the warp filaments is aligned parallel to the machine direction.

FIG. 4 is a simplified illustration of the knuckle imprint pattern which would result if a semi-twill fabric such as is illustrated in FIGS. 1 through 3 were installed so that the conventional face side of the fabric were utilized to imprint an uncreped paper web produced in accordance with the teachings of U.S. Pat. No. 3,301,746 issued to Sanford et al. on Jan. 31, 1967, said patent being incorporated herein by reference. The dot impressions 3 visible on the surface of such an uncreped paper sheet after imprinting form a pattern corresponding to the knuckles 4 of the warp filaments 1 on the conventional face side of the fabric. Since the dot impressions 3 are formed by the warp filaments 1, the long axis of the dot impressions is aligned parallel to the machine direction. The knuckles 7 formed by the woof filaments 2 on the conventional face side of the fabric do not form a corresponding impression in the uncompacted paper web due to the fact that they are at a lower relative elevation than the warp filament knuckles 4.

Figure 5:
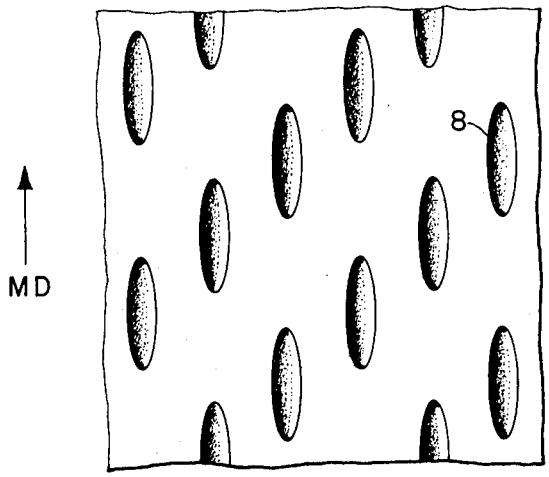
FIG. 5 is a simplified illustration of an enlarged partial plan view of an uncreped paper sheet which has been imprinted utilizing the back side of a semi-twill fabric such as is shown in FIGS. 1 through 3. The long axis of the dash impressions formed by the warp filaments is aligned parallel to the machine direction.

FIG. 5 illustrates the knuckle imprint pattern which would result if an uncompacted paper web produced in accordance with the teachings of U.S. Pat. No. 3,301,746 were imprinted utilizing the back side of an imprinting fabric such as is illustrated in FIGS. 1 through 3. Because the warp filaments 1 are at a higher relative elevation than the woof filaments 2 on the back side of the fabric, only the peaks of the knuckles 5 formed by the warp filaments are impressed into the paper web during the imprinting process. Since the warp filaments 1 run in the machine direction, the resulting pattern consists of a series of relatively long dash impressions 8, wherein the long axis of the impressions is aligned parallel to the machine direction.

The imprint pattern illustrated in FIG. 5 differs from the imprint pattern illustrated in FIG. 4 in two important respects. First, since each warp filament 1 passes over two woof filaments 2 on the back side of the semi-twill fabric as compared to only one woof filament 2 on the face side of the fabric, the length of the impressions is approximately twice as great when the web is imprinted with the back side of the fabric. Secondly, when a paper web imprinted with the pattern illustrated in FIG. 5 is removed from the drying drum by means of a conventional doctor blade, a diamond-shaped pattern is imparted to the surface of the paper, whereas when a paper web imprinted with the pattern illustrated in FIG. 4 is removed from the drying drum by means of a conventional doctor blade, a regulated creping pattern results in which the crepe ridges are substantially unbroken across the width of the sheet. This characteristic difference in finished product appears to be due to the fact that the web illustrated in FIG. 4 is adhered to the dryer drum only at interrupted intervals, i.e., by the dot impressions 3, which impressions are not sufficiently long to overlap each other in the machine direction. The paper web illustrated in FIG. 5, on the other hand, is adhered to the dryer drum in a continuous fashion, i.e., by the dash impressions 8, which impressions are sufficiently long to overlap each other in the machine direction.

Based on the teachings of the prior art, and particularly on U.S. Pat. No. 3,473,576 issued to Amneus on Oct. 21, 1969, said patent being incorporated herein by reference, it is recognized that smooth web transfers and maximum drying effectiveness are not realized with fabrics having rough or inconsistent web contacting surfaces. Smooth web transfers are particularly desirable where, as in the case of the papermaking process disclosed in U.S. Pat. No. 3,301,746, the imprinting fabric is of product characteristic importance. It has, therefore, been found desirable to utilize imprinting fabrics having uniform knuckle heights and minimum free or interstitial area on the side of the fabric contacting the uncompacted paper web. Because such imprinting fabrics are subjected to elevated temperatures during use, it has also been found desirable to dimensionally heat stabilize such fabrics prior to use to prevent warpage.

It is important to note that due to the symmetry of a plain weave fabric, uniform knuckle heights and minimum free area are achieved simultaneously on both sides of the fabric when the fabric is subjected to a heat treatment process such as that disclosed in U.S. Pat. No. 3,473,576. This is not the case with a semi-twill weave fabric. If a monofilament, polymeric fiber, semi-twill fabric is subjected to a heat treatment process such as that disclosed in U.S. Pat. No. 3,473,576, the knuckles 4 and 7 on the conventional face side of the fabric will become coplanar before the knuckles 5 and 6 on the back side of the fabric. In order for the knuckles 5 and 6 on the back side of the fabric to reach uniform heights, the fabric must be subjected to further heat treatment. The additional heat treatment in turn causes the heights of the knuckles 4 and 7 on the conventional face side of the semi-twill fabric to again become non-uniform.

Therefore, the initial warp filament spacing and caliper of a semi-twill fabric necessary to produce minimum free area and uniform knuckle heights on the back side of the fabric after heat treatment is determined experimentally by trial and error.

In a preferred embodiment of the present invention, a monofilament, polymeric fiber, semi-twill fabric is prepared by selecting warp monofilaments having a relatively high heat-induced shrinkage potential in the range of about 10 to about 30 percent, preferably about 16 percent. After selecting and spacing the warp monofilaments, polymeric woof monofilaments are selected which have a relatively low heat-induced shrinkage potential in the range of about 2 to about 8 percent, preferably about 4 percent. The heat shrinkage treatment takes advantage of the aforementioned shrinkage characteristics of the warp and woof monofilaments. The heat shrinkage treatment comprises subjecting the initially woven fabric to a series of heat applications as it is stretched and secured at its ends in the lengthwise or warp direction, while it is free to shrink in the woof direction.

The heat shrinkage treatment is conveniently applied to the initially woven semi-twill fabric while the fabric is mounted as an endless belt on a finishing table such as those conventionally used in finishing metal Fourdrinier wires. A conventional wire finishing table consists of two adjustable rolls for supporting, tensioning and driving the wire or fabric to be finished as an endless belt. The heat shrinkage can be induced conveniently by an infrared source mounted as a bank above and across the initially woven fabric. The infrared source heats areas of the initially woven fabric as the fabric slowly revolves on the rolls of the wire finishing table. Heat is applied to the fabric in successive treatments of about 5 to about 40 seconds, preferably about 15 seconds, per treatment. The fabric temperatures during the successive applications of heat approach gradually the softening point of the selected monofilament polymeric fibers. Multiple passes are used to avoid sudden shrinkage which induces fabric wrinkles. Successive heat treatments are repeated until the knuckle heights on the back side of the fabric reach uniformity, which condition should also correspond to minimum free or interstitial area if the initial warp filament spacing and caliper of the fabric have been properly determined. A semi-twill fabric which has been subjected to the aforementioned heat treatment process, although not "locked-up" as in the case of a plain weave fabric subjected to such a heat treatment process, is dimensionally heat stable at the temperatures encountered in the web imprinting process disclosed in U.S. Pat. No. 3,301,746.

The temperature of the fibers in the successive heat treating passes is increased to a maximum temperature immediately below the softening point of the selected fibers. For example, the heat treating temperature used with Treviera fibers is about 360° to about 400°F, preferably about 375°F. For dimensional heat stability in use as an imprinting fabric in accordance with the teachings of U.S. Pat. No. 3,301,746, a sufficient number of successive heating treatments or passes are employed to insure that the monofilament polymeric fibers making up the fabric structure have been at the highest heat treating temperature for a total time of about 15 to about 120 seconds.

Contrary to expectation, a weaving procedure wherein polymeric warp and woof monofilaments are merely woven as tightly as possible to insure a minimum free area will not result in a fabric with uniform knuckle heights after heat treating or use in web drying systems. Polymeric fibers in general exhibit heat shrinkage, and if such a tight weaving procedure involving initial minimum spacing in both polymeric warp and woof monofilaments is attempted, the resulting heat treated and heat stabilized fabric will exhibit non-uniform knuckle heights. Therefore, in a preferred embodiment of the present invention, an initial warp filament spacing in the loom and an initial caliper of the semi-twill fabric are determined experimentally by trial and error to take into account the heat-induced shrinkage which occurs during the above described dimensional heat stabilization process.

Figure 6:
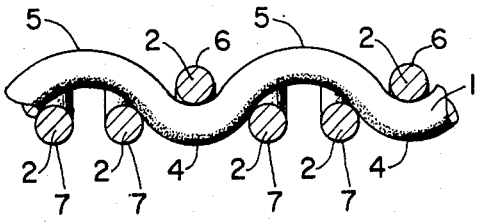
FIG. 6 is an enlarged cross-sectional view of a monofilament, polymeric fiber, semi-twill fabric such as is illustrated in FIGS. 1 through 3, taken looking in the cross-machine direction at a point corresponding to line 2—2 in FIG. 1, after the fabric has been subjected to a heat treatment process sufficient to produce uniform knuckle heights on the conventional face side of the fabric.
Figure 7:
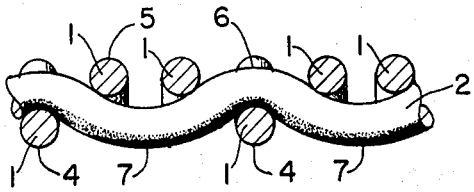
FIG. 7 is an enlarged cross-sectional view of the semi-twill fabric illustrated in FIG. 6, taken looking in the machine direction at a point corresponding to line 3—3 in FIG. 1.

FIGS. 6 and 7 are enlarged cross-sectional views of a monofilament, polymeric fiber, semi-twill fabric such as is illustrated in FIGS. 1 through 3 after a heat treatment process such as that described above has been initiated. FIG. 6 is taken looking in the cross-machine direction at a point corresponding to line 2—2 in FIG. 1, while FIG. 7 is taken looking in the machine direction at a point corresponding to line 3—3 in FIG. 1. FIGS. 6 and 7 represent an intermediate condition of the fabric which occurs during the heat treatment process, prior to achieving uniform knuckle heights and minimum free area on the back side of the fabric. FIG. 6 represents the condition which results when the warp filaments 1 tend to draw themselves closer to a straight line due to the heat induced shrinkage. The tendency of the warp filaments 1 to assume a lower total amplitude, due to the heat-induced shrinkage, forces the woof monofilaments 2 on the conventional face side of the fabric downwardly and the woof monofilaments 2 on the back side of the fabric upwardly since the ends of the woof monofilaments are not restrained. This is more clearly illustrated in FIG. 7, wherein the woof monofilaments 2 tend to wrap themselves more completely about the wrap monofilaments 1. As a result, the knuckles 7 formed by the woof monofilaments 2 become coplanar with the knuckles 4 formed by the warp monofilaments 1 located on the conventional face side of the fabric. It should be noted that, at this particular point, the knuckles 5 formed by the warp monofilaments 1 remain at a higher relative elevation than the knuckles 6 formed by the woof monofilaments 2 on the back side of the fabric.

Figure 8:
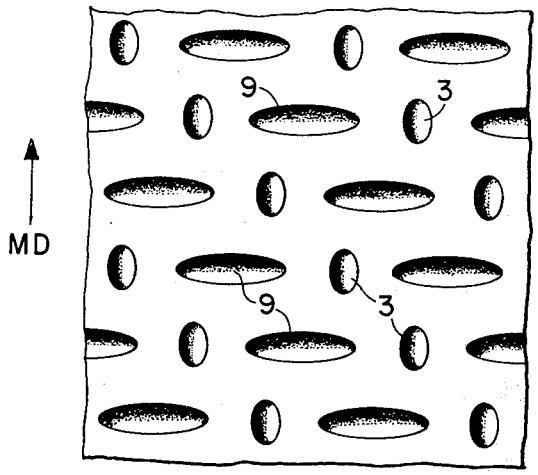
FIG. 8 is a simplified illustration of an enlarged partial plan view of an uncreped paper sheet which has been imprinted utilizing the conventional face side of a monofilament, polymeric fiber, semi-twill fabric such as is illustrated in FIGS. 6 and 7. The long axis of the dash impressions formed by the woof or weft filaments is aligned parallel to the cross-machine direction, while the long axis of the dot impressions formed by the warp filaments is aligned parallel to the machine direction.

FIG. 8 is a simplified illustration of an enlarged partial plan view of an uncreped paper sheet produced in accordance with the teachings of U.S. Pat. No. 3,301,746, which uncreped paper sheet has been imprinted utilizing the conventional face side of a monofilament, polymeric fiber, semi-twill fabric such as is illustrated in FIGS. 6 and 7. The knuckle imprint pattern is similar to that shown in FIG. 4 wherein the dot impressions 3 formed by the knuckles 4 of the warp monofilaments 1 on the conventional face side of the fabric are illustrated, but the dash impressions 9 formed by the knuckles 7 of the woof monofilaments 2 are also present. Because the woof monofilaments 2 are aligned parallel to the cross-machine direction, the long axis of the dash impressions 9 is also aligned parallel to the cross-machine direction.

Figure 9:
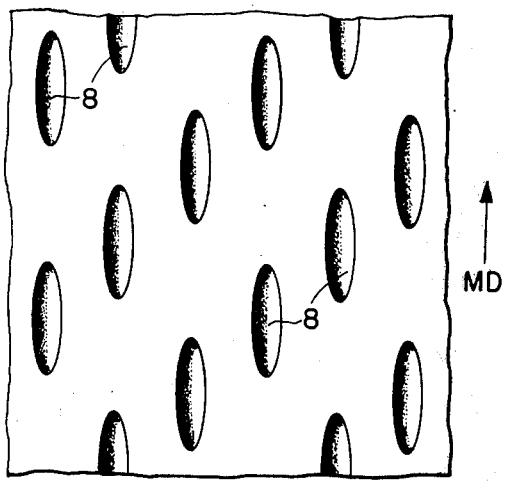
FIG. 9 is a simplified illustration of an enlarged partial plan view of an uncreped paper sheet which has been imprinted utilizing the back side of a semi-twill fabric such as is illustrated in FIGS. 6 and 7. The long axis of the dash impressions formed by the warp filaments is aligned parallel to the machine direction.

FIG. 9 is a simplified illustration of an enlarged partial plan view of an uncreped paper sheet produced in accordance with the teachings of U.S. Pat. No. 3,301,746, which uncreped paper sheet has been imprinted utilizing the back side of a semi-twill fabric such as is illustrated in FIGS. 6 and 7. As in FIG. 5, the long axis of the dash impressions 8 formed by the knuckles 5 of the warp monofilaments 1 is aligned parallel to the machine direction.

As with paper sheets imprinted with the pattern illustrated in FIG. 4, paper sheets utilizing the imprinting pattern illustrated in FIG. 8 exhibit a basic regularity of creping wherein the crepe ridges extend substantially uninterrupted across the entire width of the sheet. Addition of the dash impressions 9 to the imprinting pattern does not alter the fact that the imprinted paper sheet is adhered to the dryer drum only at interrupted intervals corresponding to the spacing, in the machine direction, of the dot impressions 3. Paper sheets imprinted with the pattern illustrated in FIG. 9, on the other hand, exhibit a diamond-shaped pattern characteristic of paper sheets made in accordance with the present invention when doctored from the dryer drum.

Figure 10:
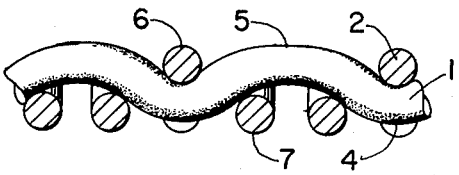
FIG. 10 is an enlarged cross-sectional view of a monofilament, polymeric fiber, semi-twill fabric such as is illustrated in FIGS. 1 through 3 and 6 and 7, taken looking in the cross-machine direction at a point corresponding to line 2—2 in FIG. 1, after the fabric has been subjected to a heat treatment process sufficient to produce uniform knuckle heights and minimum free area on the back side of the fabric. It should be noted that at this point, the knuckle heights on the conventional face side of the fabric are no longer uniform.
Figure 11:
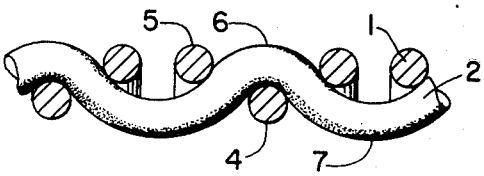
FIG. 11 is an enlarged cross-sectional view of the semi-twill fabric illustrated in FIG. 10, taken looking in the machine direction at a point corresponding to line 3—3 in FIG. 1.

In order to obtain uniform knuckle heights and minimum free area on the back side of a semi-twill fabric such as is illustrated in FIGS. 6 and 7, as is desired in a preferred embodiment of the present invention, the heat treatment process is continued until a condition similar to that illustrated in FIGS. 10 and 11 is achieved. FIG. 10 is taken looking in the cross-machine direction at a point corresponding to line 2—2 in FIG. 1, while FIG. 11 is taken looking in the machine direction at a point corresponding to line 3—3 in FIG. 1. Heat-induced shrinkage of the warp monofilaments 1, as shown in FIG. 10, has produced a lower total amplitude causing the woof monofilaments 2 on the back side of the fabric to move upwardly and the woof monofilaments 2 on the conventional face side of the fabric to move downwardly. As can be seen in FIG. 11, the woof monofilaments 2 which, unlike the warp monofilaments 1, are not subjected to tension tend to wrap themselves more completely about the warp monofilaments 1 located on the conventional face side of the fabric. Simultaneously, the woof monofilaments 2 tend to "belly" or gradually wrap themselves about the two adjacent warp monofilaments 1 located on the back side of the fabric. As a result, the heights of the warp monofilament knuckles 5 on the back side of the fabric and the woof monofilament knuckles 6 on the back side of the fabric become uniform, while the heights of the woof monofilament knuckles 7 on the conventional face side of the fabric and the warp monofilament knuckles 4 on the conventional face side of the fabric become non-uniform. If the initial warp filament spacing in the loom and the initial caliper or thickness of the semi-twill fabric have been properly determined to take into account the heat-induced shrinkage, the condition illustrated in FIGS. 10 and 11 should result, i.e., a dimensionally heat stabilized semi-twill fabric having uniform knuckle heights as well as minimum free area on its back side.

Figure 12:
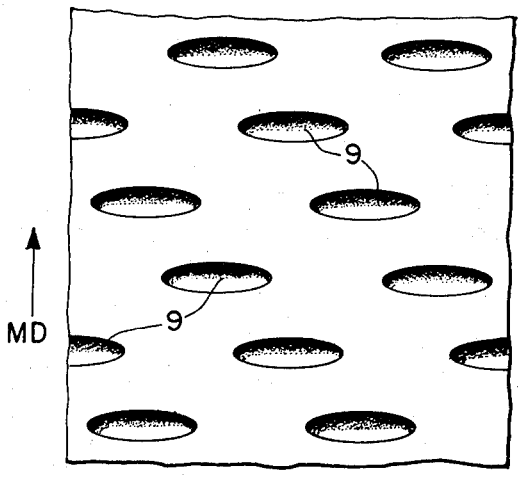
FIG. 12 is a simplified illustration of an enlarged partial plan view of an uncreped paper sheet which has been imprinted utilizing the conventional face side of a semi-twill fabric such as is illustrated in FIGS. 10 and 11. The long axis of the dash impressions formed by the woof or weft filaments is aligned parallel to the cross-machine direction.

FIG. 12 is a simplified illustration of an enlarged partial plan view of an uncreped paper sheet made in accordance with the teachings of U.S. Pat. No. 3,301,746, which uncreped paper sheet has been imprinted utilizing the conventional face side of a semi-twill fabric such as is illustrated in FIGS. 10 and 11. The imprinting pattern is basically similar to that shown in FIG. 8, but the dot impressions 3 formed by the warp monofilament knuckles 4 on the conventional face side of the fabric are no longer present due to the fact that the warp monofilament knuckles 4 are at a lower relative elevation than the woof monofilament knuckles 7 on the conventional face side of the fabric. Paper sheets imprinted with the pattern illustrated in FIG. 12 exhibit properties substantially similar to sheets imprinted with the patterns shown in FIGS. 4 and 8 after creping.

Figure 13:
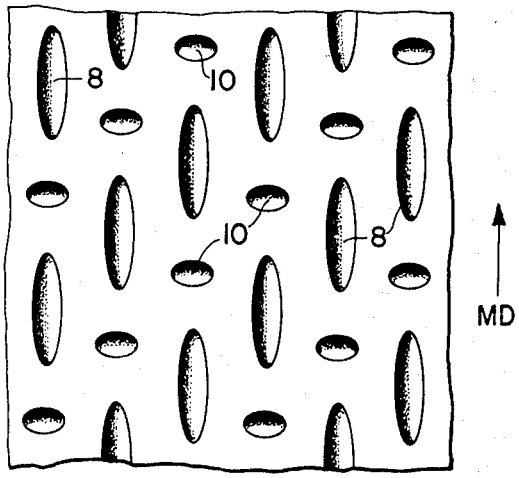
FIG. 13 is a simplified illustration of an enlarged partial plan view of an uncreped paper sheet which has been imprinted utilizing the back side of a semi-twill fabric such as is illustrated in FIGS. 10 and 11. The long axis of the dash impressions formed by the warp filaments is aligned parallel to the machine direction, while the long axis of the dot impressions formed by the woof or weft filaments is aligned parallel to the cross-machine direction. The dot impressions are present at this stage due to the fact that the knuckles on the back side of the fabric are of uniform height.

FIG. 13 is a simplified illustration of an enlarged partial plan view of an uncreped paper sheet produced in accordance with the teachings of U.S. Pat. No. 3,301,746, which uncreped paper sheet has been imprinted utilizing the back side of a semi-twill fabric such as is illustrated in FIGS. 10 and 11. The dash impressions 8 formed by the warp filament knuckles 5 on the back side of the fabric are essentially the same as those illustrated in FIG. 8, but the dot impressions 10 formed by the woof monofilament knuckles 6 on the back side of the fabric are also present due to the fact that the warp filament knuckles 5 and the woof filament knuckles 6 on the back side of the fabric are of uniform height. Paper sheets produced utilizing the back side of a semi-twill fabric such as is illustrated in FIGS. 10 and 11 for imprinting purposes exhibit a diamond-shaped surface appearance after creping, which surface appearance is characteristic of paper sheets made in accordance with applicant's invention. As the knuckle imprint area on the back side of such a monofilament, polymeric fiber, semi-twill fabric is increased, the diamond-shaped pattern becomes more pronounced.

Applicant has discovered that increasing the knuckle imprint area on the back side of such a fabric also produces certain unexpected improvements in finished sheet characteristics. These unexpected improvements take the form of greater cross-directional stretch, as well as improved softness, surface feel and drape. Increasing the knuckle imprint area on the conventional face side of a similar monofilament, polymeric fiber, semi-twill imprinting fabric does not, however, yield similar improvements in finished sheet characteristics. This is likewise true of plain weave imprinting fabrics. Applicant has thus learned unexpectedly that the above mentioned improvements in sheet characteristics are uniquely achievable by increasing the knuckle imprint area on the back side of a conventional monofilament, polymeric fiber, semi-twill imprinting fabric.

One method of increasing the knuckle imprint area of a monofilament, polymeric fiber fabric is disclosed in U.S. Pat. No. 3,573,164 issued to Friedberg et al. on Mar. 30, 1971, said patent being incorporated herein by reference, wherein the knuckle surfaces are abraded with a fine abrasive medium to improve web transfer, web drying, web product characteristics and general machine operation. In a preferred embodiment of the present invention, the monofilament, polymeric fiber, semi-twill imprinting fabric to be abraded is brought to the condition illustrated in FIGS. 10 and 11, i.e., uniform knuckle heights and minimum free area on its back side, prior to initiating any abrading treatment. Although the abrasion treatment disclosed in the aforementioned Friedberg et al. patent will produce uniform knuckle heights on a fabric which does not initially have uniform knuckle heights, it is most desirable, in a preferred embodiment of the present invention, to utilize a fabric initially having uniform knuckle heights on the side to be treated to minimize the possibility of abrading completely through one or more monofilaments during the abrading process. Therefore, the back side of a fabric such as is shown in FIGS. 10 and 11 can undergo a more extensive abrading process, thus producing a greater increase in knuckle imprint area than is permissible with a fabric initially having non-uniform knuckle heights on the side to be treated.

As mentioned earlier in this specification, it has been found desirable that monofilament, polymeric fiber fabrics be dimensionally heat stabilized prior to use. Failure to do so can cause warpage after the fabric has been placed in service and subjected to elevated temperatures. Thus, to realize the full benefits to be obtained by the abrading process, it is most desirable, in a preferred embodiment of the present invention, that the semi-twill fabric be dimensionally heat stabilized in accordance with the procedures described in this specification prior to initiating the abrading treatment.

In accordance with the teachings of the aforementioned Friedberg et al. patent, the back side of a monofilament, polymeric fiber, semi-twill imprinting fabric, in a preferred embodiment of the present invention, is subjected to a treatment wherein the knuckle surfaces of the fabric are abraded using either a wet or dry sandpaper having an effective abrasive grain size of about 300 mesh to about 500 mesh as an abrasive medium. The abrasive media can be mounted on drums for rotative application to the fabric knuckle surfaces. The abrasing process can be performed while continuously showering the fabric with water or other cleansing and lubricating fluid, for example light oil, to remove abraded particles and facilitate the polishing operation.

In a preferred embodiment of the present invention, a total knuckle imprint area of about 20 to about 50 percent of the total fabric surface area, as measured in the plane of the knuckles, is developed on the treated surface. Increasing the knuckle imprint area beyond the 50 percent level greatly increases the danger of abrading completely through particular monofilaments and is also likely to have a detrimental effect on the fabric life.

In yet another preferred embodiment of the present invention, it is desirable to form a smooth and polished surface on the knuckles on the back side of the monofilament, polymeric fiber semi-twill fabric. To this end, the above described abrading operation can be conducted in several stages. For example, the initial abrasion can be carried out with an abrasive medium having an effective abrasive grain size of about 300 mesh, and this initial abrading operation can be followed by an abrasive polishing treatment using a water lubricated wet sandpaper having an effective abrasive grain size of about 500 mesh. Polishing abrasives such as talc, rouge and crocus cloth can also be used to further polish the knuckle surfaces.

Figure 14:
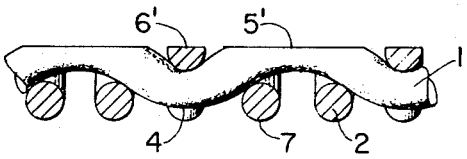
FIG. 14 is an enlarged cross-sectional view of a monofilament, polymeric fiber, semi-twill fabric such as is illustrated in FIGS. 10 and 11, taken looking in the cross-machine direction at a point corresponding to line 2—2 in FIG. 1, after the back side of the fabric has been abraded to increase its knuckle imprint area.
Figure 15:
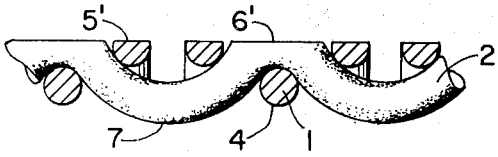
FIG. 15 is an enlarged cross-sectional view of the semi-twill fabric illustrated in FIG. 14, taken looking in the machine direction at a point corresponding to line 3—3 in FIG. 1.
Figure 16:
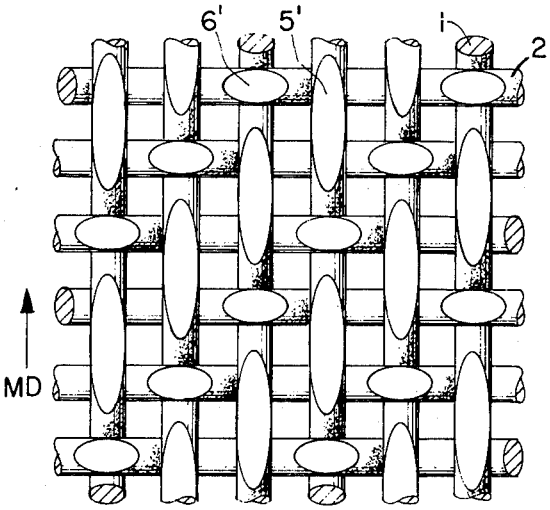
FIG. 16 is a plan view of an enlarged portion of the monofilament, polymeric fiber, semi-twill fabric illustrated in FIGS. 14 and 15, as viewed from the back side of the fabric.

FIGS. 14 and 15 are enlarged cross-sectional views of a monifilament, polymeric fiber, semi-twill fabric such as is illustrated in FIGS. 10 and 11 after the back side of the fabric has been abraded to increase its knuckle imprint area to between about 20 and about 50 percent of the total fabric surface area, as measured in the plane of the knuckles. FIG. 16 is a plan view of an enlarged portion of the fabric illustrated in FIGS. 14 and 15, as viewed from the back side of the fabric. The fabric illustrated in FIGS. 14 through 16 represents a preferred embodiment of the present invention, wherein uniform knuckle heights and minimum free area were achieved on the back side of the fabric prior to initiating the abrading process. An inherent advantage associated with obtaining uniform knuckle heights and minimum free area prior to initiating the abrading treatment is in the uniform consistency of the knuckle imprint pattern which results after the abrading process has been completed. This latter feature is most clearly illustrated in FIG. 16.

FIGS. 14 and 15, taken looking in the cross-machine and machine directions respectively, illustrate the fabric profile which is presented to an uncompacted paper web when the fabric is utilized for imprinting purposes in accordance with the teachings of U.S. Pat. No. 3,301,746. The warp filament knuckles 5 and the woof filament knuckles 6 as shown in FIGS. 10 and 11 have been abraded to form the plateau-like warp filament knuckles 5' and woof filament knuckles 6' illustrated in FIGS. 14 and 15. In addition to improving web transfer and web drying characteristics, the plateau-like knuckle surfaces 5' and 6' impress and uncompacted paper web to a uniform depth, thus producing a more distinct imprint pattern.

The moist paper web carried on an imprinting fabric of the present invention can be thermally pre-dryed by means of passing hot gases, for example air, through the moist paper web and the imprinting fabric. One suitable apparatus for pre-drying the moist paper web is disclosed in U.S. Pat. No. 3,303,576 issued to Sisson on Feb. 14, 1967, which patent is incorporated herein by reference., Although the means by which thermal pre-drying is accomplished is not critical, it is critical that the relationship of the moist web to the imprinting fabric be maintained once established.

According to the teachings of U.S. Pat. No. 3,301,746, thermal pre-drying is used to effect a fiber consistency in the moist paper web from about 30 to about 80 percent, preferably about 40 to about 80 percent. The aforementioned Sanford et al. patent further teaches that at fiber consistencies less than about 30 percent, the desirably balanced sheet characteristics of softeness, bulk and absorbency suffer because the sheet and the fibers thereof are too moist, and yielding occurs during the imprinting step. The aforementioned Sanford et al. patent also teaches that pre-drying to fiber consistencies above about 80 percent precludes the development of effective tensile strengths in the imprinted paper sheet.

Based on the Sanford et al. patent and the application of Gregory A. Bates, Ser. No. 452,610 filed Mar. 19, 1974 and entitled TRANSFER AND ADHERENCE OF RELATIVELY DRY PAPER WEB TO A ROTATING CYLINDRICAL SURFACE, now U.S. Pat. No. 3,926,716, said application and said patent being commonly owned by the assignee of the present invention and incorporated herein by reference, it is now known that fiber consistencies between about 30 and about 98 percent prior to transfer of the web to the drying drum are possible without adversely affecting the tensile strength of paper sheets thus produced. Fiber consistencies in the higher end of the range, i.e., above about 80 percent, are now known to be a function of the adhesive sprayed on the surface of the drying drum prior to web transfer, as explained in detail in the aforementioned patent of Bates.

Imprinting the fabric knuckle pattern in the moist web by pressing the pre-dryed web against a relatively non-yielding surface, for example, an unheated steel roll or a Yankee dryer surface, while the pre-dryed web is yet carried on the imprinting fabric results in a paper sheet having impressed in its surface, to a depth of at least 30 percent of its machine glazed caliper the knuckle pattern of the imprinting fabric. Machine glazed claiper refers to the caliper of the paper sheet taken directly from the Yankee dryer, before creping. Thus, the knuckle surfaces 5' and 6', illustrated in FIGS. 14 through 16 in a preferred embodiment of the present invention, are impressed to a uniform depth of at least 30 percent of the machine glazed caliper of the uncreped paper sheet.

The pressure required for the imprinting of the imprinting fabric pattern can be provided, in a preferred embodiment of the present invention, by one or more pressure rolls operating on the imprinting fabric to force the knuckles of the fabric into the surface of the pre-dryed web and to force the pre-dryed web surface under the knuckles against a Yankee dryer surface.

It should be understood that it is critical to the practice of the present invention that the imprinting step described above be the first substantial overall mechanical compaction step which the paper web has received during formation and pre-drying.

Figure 17:
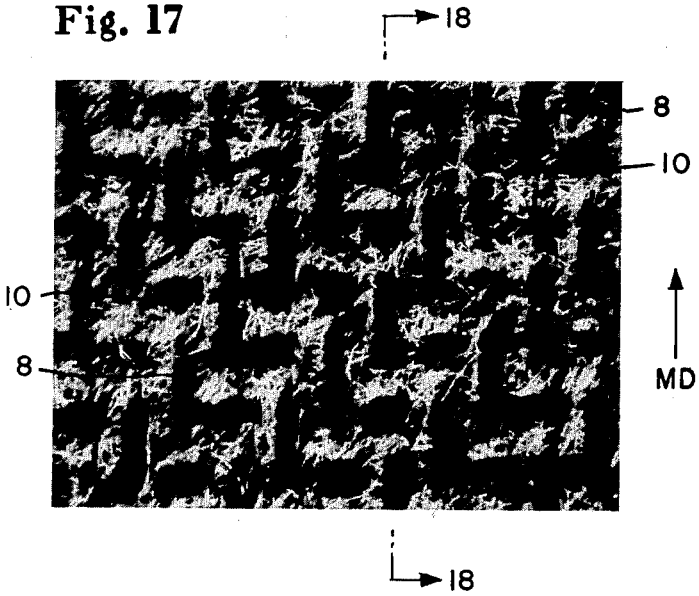
FIG. 17 is a plan view photograph, enlarged about 12 times actual size, of an uncreped paper sheet which has been imprinted utilizing the back side of a semi-twill fabric such as is shown in FIGS. 14, 15, and 16. The pattern produced is similar to that shown in FIG. 13, but the dot-dash impressions constitute a greater percentage of the surface area of the paper due to the increased knuckle imprint area of the fabric.

FIG. 17 is a photograph of an enlarged partial plan view of an uncreped paper sheet made in accordance with the teachings of U.S. Pat. No. 3,301,746, utilizing the back side of a semi-twill fabric such as is illustrated in FIGS. 14 through 16 to imprint the uncompacted paper web. The resulting knuckle imprint pattern is basically similar to that shown in FIG. 13. However, the dash impressions 8 formed by the warp filament knuckles 5' and the dot impressions 10 formed by the woof filament knuckles 6' constitute a greater percentage of the sheet's surface area due to the increase in the size of the fabric knuckles. In addition, the impressions 8 and 10 are more distinct due to the fact that they are of substantially uniform depth, having been produced by the plateau-like surfaces of the knuckles 5' and 6'.

Figure 18:
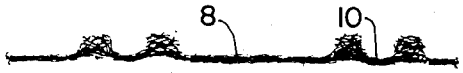
FIG. 18 is an illustration of an enlarged cross-sectional view of the uncreped paper sheet of FIG. 17, taken looking in the cross-machine direction along line 18—18 in FIG. 17.

FIG. 18 is an illustration of an enlarged cross-sectional view of the uncreped paper sheet of FIG. 17, taken looking in the cross-machine direction along line 18—18 in FIG. 17.

Figure 19:
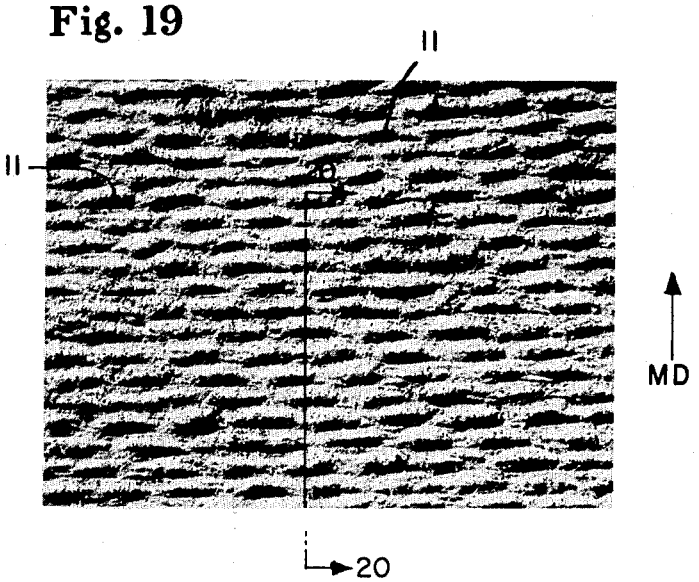
FIG. 19 is a plan view photograph, enlarged about 6 times actual size, of a paper sheet such as is shown in FIGS. 17 and 18 after creping. The long axis of the impressions visible after creping is oriented generally in the cross-machine direction, while the overall surface of the paper exhibits a diamond-shaped pattern characteristic of paper sheets made in accordance with the present invention.

FIG. 19 is a photograph of an enlarged partial plan view of a creped paper sheet made in accordance with the teachings of U.S. Pat. No. 3,301,746, utilizing the back side of a semi-twill fabric such as is illustrated in FIGS. 14 through 16 to imprint the uncompacted paper web prior to creping. The long axis of the impressions 11 visible after creping appears to be oriented generally in the cross-machine direction. Unlike paper sheets made in accordance with the teachings of the aforementioned Sanford et al. patent utilizing either a similarly prepared plain weave imprinting fabric or the conventional face side of a similarly prepared semi-twill imprinting fabric, the overall surface of the paper exhibits a diamond-shaped pattern rather than uniform unbroken creping ridges extending across the width of the sheet.

Figure 20:
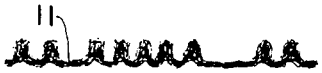
FIG. 20 is an illustration of an enlarged cross-sectional view of the creped paper sheet of FIG. 19, taken looking in the cross-machine direction along line 20—20 in FIG. 19.

FIG. 20 is an illustration of an enlarged cross-sectional view of the paper sheet of FIG. 19, taken looking in the cross-machine direction along line 20—20 in FIG. 19.

A finished paper sheet such as is illustrated in FIGS. 19 and 20, produced in accordance with the present invention, exhibits improvements in cross-directional stretch, softness, surface feel and drape which are not achievable by the paper manufacturing process disclosed in U.S. Pat. No. 3,301,746 when a similarly prepared plain weave fabric or when the conventional face side of a similarly prepared semi-twill fabric are utilized to imprint an uncompacted paper web prior to creping. Increasing the knuckle imprint area on a plain weave fabric or on the conventional face side of a semi-twill fabric, although improving web transfer and web drying characteristics, does not produce the improvements in cross-directional stretch, softness, surface feel and drape which are realized by increasing the knuckle imprint area on the back side of a semi-twill imprinting fabric.

From the foregoing general and specific description of the present process, it is apparent that the critical procedures to be carried out are the formation of an uncompacted paper web at a specified range of fiber consistency and the imprinting thereof by the knuckles on the back side of a monofilament, polymeric fiber, semi-twill imprinting fabric, said fabric having a knuckle imprint area constituting about 20 to about 50 percent of the total surface area on the back side of the fabric, as measured in the plane of the knuckles. The formation of the paper web and the final drying techniques together with the pre-drying imprinting and creping procedures can be varied by one skilled in the art to produce distinctive papers for various uses while remaining within the scope of this invention By the foregoing procedures, creped paper sheets exhibiting a diamond-shaped surface appearance, composed substantially of cellulosic fibers, having basis weights of from about 5 to about 40 pounds per 3000 square feet, and exhibiting a repeating pattern of discrete impressed areas are produced.

In order to demonstrate the improvements characteristic of finished product made in accordance with applicant's invention, a series of test runs were made to compare the characteristics of paper sheets made in accordance with the teachings of U.S. Pat. No. 3,301,746, utilizing different sides of a monofilament, polymeric fiber, semi-twill fabric. Paper machine conditions, with the exception of the imprinting fabric, were maintained constant for the entire series of tests.

Furnish comprised of a 50 percent softwood kraft and a 50 percent hardwood sulfite stock was utilized throughout the entire series of tests.

An adhesive coat was applied to the Yankee dryer surface by utilizing a wire glue roll of approximately 40 mesh turning at a lineal speed of approximately 9 feet per minute at its periphery in an open glue pot and then spraying the glue picked up on the wire mesh glue roll onto the surface of the Yankee dryer drum by means of a series of air jets located interiorly of the glue roll and operating continuously at an air pressure of 75 p.s.i.g. The glue utilized was purchased under the specification Peter Cooper IX from the Peter Cooper Corporation of Gowanda, N.Y. The mixture, as applied, contained 1 part glue and 99 parts water. The pre-dryed and imprinted web was caused to part from the imprinting fabric at the pressure nip exit and adhere to the Yankee dryer surface by means of the adhesive coat described above.

The dry creped sheet was removed from the Yankee dryer by means of a conventional doctor blade so that the finished product had 12 percent stretch as crepe folds.

Two separate monofilament, polymeric fiber, semi-twill fabrics were utilized during the test runs. The fabrics were both 31 (machine direction) by 28 (cross-machine direction) mesh utilizing warp and woof monofilaments having a diameter of 0.45 mm. (about 0.018 inches). One of the fabrics was woven so as to present its back side as a web contacting surface and the other was woven so as to present its conventional face side as a web contacting surface. Both of the fabrics, as received, were in a configuration similar to that illustrated in FIGS. 10 and 11, i.e., the heights of the warp filament knuckles 5 and the woof filament knuckles 6 on the back side of each fabric were approximately equal, while the warp filament knuckles 4 were at a lower relative elevation than the woof filament knuckles 7 on the conventional face side of each fabric.

In order to isolate the effect of the imprinting fabrics on finished sheet characteristics, the fabrics were installed successively on the same paper machine in the as-received condition, and paper sheets were produced in accordance with the teachings of U.S. Pat. No. 3,301,746.

The fabric woven so as to present its back side as a web contacting surface was found to have an initial knuckle imprint area of about 21.2 percent in the as-received condition, while the fabric woven so as to present its conventional face side as a web contacting surface was found to have a knuckle imprint area of about 23.4 percent in the as-received condition.

Data taken from paper samples made utilizing the imprinting fabric having its back side in contact with the uncompacted paper web is reported hereinbelow under Example I. Data taken from paper samples made utilizing the imprinting fabric having its conventional face side in contact with the uncompacted paper web is reported hereinbelow under Example II. Wih the exception of the imprinting fabrics, the paper machine conditions were unchanged between Examples I and II.

To illustrate the effect of increasing the knuckle imprint area on the web contacting side of the imprinting fabrics, each fabric was abraded in accordance with the teachings of U.S. Pat. No. 3,573,164. The knuckle imprint area on the fabric utilizing its back side as a web contacting surface was increased from approximately 21.2 percent to approximately 28.4 percent, while the knuckle imprint area on the fabric utilizing its conventional face side as a web contacting surface was increased from approximately 23.4 percent to approximately 34.1 percent. The tests were repeated keeping all paper machine conditions, other than the increased knuckle imprint area of the fabrics, unchanged. The results of tests performed on sample paper sheets taken during each run are tabulated hereinbelow under Examples III and IV. The data set forth in Example III is taken from sample sheets made utilizing the semi-twill imprinting fabric which presented its back side to the uncompacted paper web, while the data set forth in Example IV is taken from sample sheets made utilizing the semi-twill fabric which presented its conventional face side to the uncompacted paper web.

Finally, the knuckle imprint area of each fabric was further increased in accordance with the teachings of U.S. Pat. No. 3,573,164 until the fabric utilizing its back side as a web contacting surface achieved a total knuckle imprint area of 37.3 percent, while the fabric utilizing its conventional face side as a web contacting surface achieved a total knuckle imprint area of 40.0 percent. The tests were repeated keeping all paper machine conditions, other than the knuckle imprint area of the fabrics, unchanged. The results of tests performed on sample paper sheets taken during each run are tabulated hereinbelow under Examples V and VI. Data set forth in Example V is taken from paper sheets made utilizing the semi-twill fabric which presented its back side to the uncompacted paper web, while data set forth in Example VI is taken from paper sheets made utilizing the semi-twill fabric which presented its conventional face side to the uncompacted paper web.

The caliper of a paper sheet at 80 grams per square inch, as tabulated in the Examples hereinbelow, is the thickness of that sheet when subjected to a compressive load of 80 grams per square inch.

The tensile strengths in the machine direction (MD) and cross-machine direction (CD), as tabulated in the Examples hereinbelow, are reported as the force in grams that a 1 inch wide sample with a 4 inch span between the tensile tester clamps, cut in the MD or CD direction, can withstand before breaking, as measured on a standard Thwing-Albert Tensile Tester such as is available from the Thwing-Albert Instrument Company of Philadelphia, Pa.

The percentage stretch data tabulated in the Examples hereinbelow was determined concurrently with the determination of MD and CD tensile strengths as described above.

A Thwing-Albert Handle-O-Meter, cataloque number 211-3, such as is available from the Twing-Albert Instrument Company of Philadelphia, Pennsylvania, was used to measure a combination of stiffness and sliding friction of the paper samples. A high Handle-O-Meter or H-O-M reading indicates a lack of softness and is, therefore, undesirable. A lower H-O-M- reading indicates a softer sheet. Two 4½ by 4½ inch paper samples were placed side by side over the 0.25 inch wide Handle-O-Meter slot located beneath the blade of the unit. To determine the machine direction Handle-O-Meter reading of the sheets, the machine direction of the paper samples was aligned parallel to the Handle-O-Meter blade. To determine the cross-machine direction Handle-O-Meter reading, the machine direction of the sample sheets was aligned perpendicular to the blade of the Handle-O-Meter. Readings taken directly from the standard 50 micro-ampere meter mounted on the Handle-O-Meter are reported in the Examples hereinbelow.

In order to quantify sheet properties relating to surface feel and drape, resort was had to the principles of textile testing. Fabric handle, as its name implies, is concerned with the feel of the material and so depends on the sense of touch. When the handle of a fabric is judged, the sensations of stiffness or limpness, hardness or softness, and roughness or smoothness are all made use of. Drape has a rather different meaning and very broadly is the ability of a fabric to assume a graceful appearance in use. Experience in the textile industry has shown that fabric stiffness is a key factor in the study of handle and drape.

One instrument devised by the textile industry to measure stiffness is the Shirley Stiffness Tester. In order to compare the drape and surface feel properties of paper samples made utilizing different sides of a semi-twill imprinting fabric, a Shirley Stiffness Tester was constructed to determine the "bending length" of the paper samples, and hence to calculate values for "flexural rigidity" and "bending modulus".

The Shirley Stiffness Tester is described in *ASTM Standard Method No.* 1388. The horizontal platform of the instrument is supported by two side pieces made of plastic. These side pieces have engraved on them index lines at the standard angle of deflection of 41½°. Attached to the instrument is a mirror which enables the operator to view both index lines from a convenient position. The scale of the instrument is graduated in centimeters. The scale may be used as a template for cutting the specimens to size.

To carry out a test, a rectangular strip of paper, 6 by 1 inch, is cut to the same size as the scale and then both scale and specimen are transferred to the platform with the specimen underneath. Both are slowly pushed forward. The strip of paper will commence to droop over the edge of the platform as the scale and specimen are advanced. Movement of the scale and the specimen is continued until the tip of the specimen viewed in the mirror cuts both of the index lines. The amount of overhang, "$\int$", can immediately be read off from the scale mark opposite a zero line engraved on the side of the platform.

Due to the fact that paper assumes a permanent set after being subjected to such a stiffness test, four individual specimens were utilized to test the stiffness of the paper along a given axis, and an average value for the particular axis was then calculated. Samples were cut both on and across the cross-machine direction (CD) axis, on and across the CD+30° axis, and on and across the CD+135° axis. From the data collected both on and perpendicular to each of the three aforementioned axes, an average overhang value, $\int$, was calculated for the particular paper sample.

The bending length, c, for purposes of these tests, shall be defined as the length of paper that will bend under its own weight to a definite extent. It is a measure of the stiffness that determines draping quality. The caluclation is as follows:

$$c = \text{"}\textstyle\int\text{"}\,\text{cm.} \times f(\theta) \text{ where}$$

$$f(\theta) = \{\cos \tfrac{1}{2}\theta \div 8 \tan \theta\}^{1/3}, \text{ and}$$

"$\int$" = the average overhang value of the particular paper sample as determined above.

In the case of the Shirley Stiffness Tester, the angle $\theta = 41\frac{1}{2}°$, at which angle $f(\theta)$ or $f(41\frac{1}{2}°) = 0.5$. Therefore, the above calculation simplifies to:

$$c = \quad \times (0.5) \text{ cm.}$$

Flexural rigidity, "G", is a measure of stiffness associated with handle. The calculation of flexural rigidity, G, in the present instance is as follows:

G = 0.1629 × (basis weight of the particular paper sample in pounds per 3,000 sq. ft.) × $c^3$mg. cm., where $c$ = the bending length of the particular paper sample as determined above, expressed in cm.

The bending modulus, $q$, as reported in the Examples hereinbelow, is independent of the dimensions of the strip tested and may be regarded as the "intrinsic stiffness" of the material. Therefore, this value may be used to compare the stiffness of materials having different thicknesses. For its calculation, the thickness or caliper of the paper sample must be measured at a pressure of 1 pound per square inch.

The bending modulus, $q$, is then given by:

$$q = 732 \times G \div g^3 \text{kg./sq.cm.},$$

where $G$ is the flexural rigidity of the particular paper sample as determined above, expressed in mg. cm., and $g$ is the thickness or caliper of the particular paper sample, expressed in mils, when subjected to a pressure of 1 pound per square inch.

The results of tests performed on sample paper sheets produced during the runs described above are reported in the Examples hereinbelow in terms of bending modulus, $q$, which has relevance with respect to both drape and surface feel. A lower bending modulus corresponds to increased drape, and hence to improved surface feel.

The knuckle imprint areas referred to in the Examples hereinbelow were determined by making an impression with pressure sensitive paper in each of four areas on the web contacting surface of the imprinting fabric utilized in the particular Example. Enlarged photographs were taken of each of the four impressions, and a "unit-cell" of knuckles, i.e., one repeating pattern of knuckles, was enclosed in each photograph. The total area of each enclosed unti-cell and the total area of the knuckles inside each such unit-cell were then measured, and the results were expressed in terms of the percentage of knuckle area. The average value for the four discrete unit-cells was taken to be the knuckle imprint area for the particular Example.

The Examples below compare the finished sheet properties of paper samples produced in accordance with the present invention with the sheet properties of paper samples produced utilizing the conventional face side of a similar imprinting fabric at various stages of fabric treatment.

EXAMPLE I

| | | | Back side of imprinting fabric contacting web | | | | | | | |
|---|---|---|---|---|---|---|---|---|---|---|
| Sample no. (for indentification purposes only) | Caliper at 80 gm/sq.in., inches | Knuckle imprint area, percent | Basis weight pounds/3,000 sq.ft. | Tensile MD,gm./in. | Tensile CD,gm./in. | Handle-O-Meter MD | Handle-O-Meter CD | Stretch MD,percent | Stretch CD,percent | bending Modulus "q",kg./sq.cm. |
| 1 | 0.0106 | 21.2 | 15.4 | 251 | 224 | 8.25 | 3.0 | 16.5 | 2.0 | 10.27 |
| 2 | 0.0104 | 21.2 | 16.5 | 259 | 170 | 6.25 | 2.75 | 17.0 | 3.0 | 10.25 |
| 3 | 0.0106 | 21.2 | 15.5 | 325 | 161 | 11.25 | 3.0 | 18.0 | 3.0 | 10.38 |
| 4 | 0.0108 | 21.2 | 15.0 | 268 | 116 | 8.5 | 2.5 | 19.0 | 3.0 | 9.00 |
| 5 | 0.0116 | 21.2 | 15.8 | 181 | 114 | 6.25 | 2.75 | 19.0 | 3.0 | 7.38 |
| 6 | 0.0107 | 21.2 | 15.0 | 251 | 248 | 10.5 | 3.0 | 20.0 | 2.5 | 9.08 |
| 7 | 0.0107 | 21.2 | 15.5 | 219 | 183 | 9.5 | 3.0 | 16.5 | 3.0 | 8.38 |

EXAMPLE II

Conventional face side of imprinting fabric contacting web

| Sample no. (for indentification purposes only) | Caliper at 80 gm/sq.in., inches | Knuckle imprint area, percent | Basis weight pounds/3,000 sq.ft. | Tensile MD,gm./in. | Tensile CD,gm./in. | Handle-O-Meter MD | Handle-O-Meter CD | Stretch MD,percent | Stretch CD,percent | Bending Modulus "q",kg./sq.cm. |
|---|---|---|---|---|---|---|---|---|---|---|
| | 0.0100 | 23.4 | 15.8 | 209 | 144 | 7.0 | 2.0 | 20.0 | 3.0 | 11.33 |
| 2 | 0.0102 | 23.4 | 15.5 | 199 | 147 | 8.25 | 2.0 | 21.0 | 2.0 | 11.04 |
| 3 | 0.0106 | 23.4 | 15.1 | 155 | 130 | 8.50 | 2.0 | 20.5 | 2.0 | 8.60 |
| 4 | 0.0105 | 23.4 | 15.3 | 175 | 141 | 8.25 | 2.0 | 20.0 | 2.0 | 12.27 |
| 5 | 0.0091 | 23.4 | 15.4 | 331 | 241 | 11.5 | 3.0 | 21.0 | 2.0 | 21.60 |
| 6 | 0.0097 | 23.4 | 15.2 | 350 | 194 | 10.5 | 2.5 | 19.5 | 3.0 | 22.01 |
| 7 | 0.0107 | 23.4 | 15.3 | 266 | 194 | 10.5 | 3.0 | 22.0 | 2.5 | 10.21 |

EXAMPLE III

Back side of imprinting fabric contacting web

| Sample no. (for indentification purposes only) | Caliper at 80 gm/sq.in., inches | Knuckle imprint area, percent | Basis weight pounds/3,000 sq.ft. | Tensile MD,gm./in. | Tensile CD,gm./in. | Handle-O-Meter MD | Handle-O-Meter CD | Stretch MD,percent | Stretch CD,percent | Bending Modulus "q",kg./sq.cm. |
|---|---|---|---|---|---|---|---|---|---|---|
| 1 | 0.0097 | 28.4 | 16.9 | 278 | 218 | 7.0 | 2.3 | 18.5 | 3.5 | 10.53 |
| 2 | 0.0105 | 28.4 | 15.7 | 280 | 159 | 5.80 | 2.0 | 19.5 | 3.5 | 8.41 |
| 3 | 0.0099 | 28.4 | 15.2 | 300 | 221 | 10.5 | 2.0 | 19.0 | 3.5 | 11.12 |
| 4 | 0.0105 | 28.4 | 14.7 | 199 | 153 | 6.5 | 2.0 | 19.0 | 4.0 | 5.76 |
| 5 | 0.0105 | 28.4 | 15.1 | 193 | 150 | 6.80 | 2.0 | 18.0 | 3.5 | 5.76 |
| 6 | 0.0103 | 28.4 | 15.4 | 299 | 266 | 10.0 | 2.5 | 20.5 | 3.0 | 10.50 |
| 7 | 0.0105 | 28.4 | 16.0 | 275 | 190 | 5.3 | 2.0 | 20.5 | 4.5 | 8.37 |

EXAMPLE IV

Conventional face side of imprinting fabric contacting web

| Sample no. (for indentification purposes only) | Caliper at 80 gm/sq.in., inches | Knuckle imprint area, percent | Basis weight pounds/3,000 sq.ft. | Tensile MD,gm./in. | Tensile CD,gm./in. | Handle-O-Meter MD | Handle-O-Meter CD | Stretch MD,percent | Stretch CD,percent | Bending Modulus "q",kg./sq.cm. |
|---|---|---|---|---|---|---|---|---|---|---|
| 1 | 0.0089 | 34.1 | 15.4 | 410 | 241 | 11.5 | 2.0 | 26.5 | 2.0 | 19.64 |
| 2 | 0.0087 | 34.1 | 15.9 | 471 | 295 | 16.5 | 3.0 | 26.5 | 2.0 | 26.35 |
| 3 | 0.0091 | 34.1 | 15.6 | 330 | 201 | 14.5 | 2.0 | 24.0 | 2.5 | 20.11 |
| 4 | 0.0090 | 34.1 | 14.9 | 291 | 174 | 9.75 | 2.0 | 21.5 | 3.0 | 20.68 |
| 5 | 0.0093 | 34.1 | 15.3 | 255 | 196 | 15.5 | 2.5 | 21.5 | 2.0 | 18.41 |
| 6 | 0.0097 | 34.1 | 15.5 | 290 | 191 | 12.5 | 2.0 | 25.0 | 2.5 | 14.82 |
| 7 | 0.0093 | 34.1 | 14.7 | 263 | 190 | 9.5 | 2.0 | 24.0 | 3.0 | 16.00 |

EXAMPLE V

Back side of imprinting fabric contacting web

| Sample no. for indentification purposes only) | Caliper at 80 gm/sq.in., inches | Knuckle imprint area, percent | Basis weight pounds/3,000 sq.ft. | Tensile MD,gm./in. | Tensile CD,gm./in. | Handle-O-Meter MD | Handle-O-Meter CD | Stretch MD,percent | Stretch CD,percent | Bending Modulus "q",kg./sq.cm. |
|---|---|---|---|---|---|---|---|---|---|---|
| 1 | 0.0092 | 37.3 | 15.5 | 269 | 188 | 6.0 | 2.5 | 19.2 | 5.0 | 8.75 |
| 2 | 0.0099 | 37.3 | 16.4 | 268 | 164 | 5.5 | 2.0 | 21.5 | 5.0 | 6.07 |
| 3 | 0.0098 | 37.3 | 15.6 | 338 | 243 | 7.0 | 2.5 | 20.5 | 5.5 | 10.48 |
| 4 | 0.0093 | 37.3 | 15.1 | 271 | 171 | 5.5 | 2.0 | 19.5 | 5.5 | 6.73 |
| 5 | 0.0099 | 37.3 | 15.9 | 206 | 136 | 5.80 | 2.0 | 19.5 | 5.0 | 6.03 |
| 6 | 0.0107 | 37.3 | 16.1 | 265 | 191 | 9.0 | 2.5 | 21.0 | 5.5 | 9.25 |
| 7 | 0.0099 | 37.3 | 15.8 | 259 | 200 | 5.5 | 2.0 | 20.5 | 5.5 | 6.80 |

EXAMPLE VI

Conventional face side of imprinting fabric contacting web

| Sample no. (for indentification purposes only) | Caliper at 80 gm/sq.in., inches | Knuckle imprint area, percent | Basis weight pounds/3,000 sq.ft. | Tensile MD,gm./in. | Tensile CD,gm./in. | Handle-O-Meter MD | Handle-O-Meter CD | Stretch MD,percent | Stretch CD,percent | Bending Modulus "q",kg./sq.cm. |
|---|---|---|---|---|---|---|---|---|---|---|
| 1 | 0.0085 | 40.0 | 15.4 | 315 | 216 | 10.25 | 2.0 | 24.0 | 2.0 | 26.53 |
| 2 | 0.0087 | 40.0 | 14.3 | 303 | 209 | 12.5 | 2.0 | 23.5 | 2.0 | 22.04 |
| 3 | 0.0088 | 40.0 | 14.8 | 300 | 228 | 14.5 | 2.0 | 23.0 | 2.0 | 20.66 |
| 4 | 0.0091 | 40.0 | 14.5 | 304 | 213 | 12.25 | 2.0 | 23.0 | 2.0 | 15.66 |

The data presented in the Examples above clearly show the advantages of the present invention in producing a paper sheet characterized by having significantly improved cross-directional stretch, softness, surface feel and drape.

It is to be understood that the forms of the invention herein illustrated and described are to be taken as preferred embodiments. Various changes or omissions may be made in the weaving process, the heat treating process, or in the process for increasing the knuckle imprint area of the fabric without departing from the spirit or scope of the invention as defined in the attached claims.

Having thus defined and described the invention, what is claimed is:

1. A soft, bulky and absorbent creped paper sheet characterized by having a uniform basis weight of from about 5 to about 40 pounds per 3,000 square feet, by having imprinted in its surface, to a depth of at least 30 percent of its machine glazed caliper, the knuckle pattern of the back side of a semi-twill imprinting fabric having about 20 to about 60 meshes per inch, by having about 20 to about 50 percent of its surface compressed in said dot-dash knuckle pattern such that the long axis of the dash impressions in said pattern is aligned parallel to the machine direction during the formation of said paper sheet, said paper sheet being further characterized by having a cross-directional stretch of at least about 3.5 percent after creping of said knuckle pattern-imprinted sheet.

2. The soft, bulky and absorbent sheet described in claim 1 which sheet exhibits a diamond-shaped pattern in its surface.

3. A soft, bulky and absorbent creped paper sheet characterized by having a uniform basis weight of about 5 to about 40 pounds per 3000 square feet, by having imprinted in its surface, to a depth of at least 30 percent of its machine glazed caliper, the knuckle pattern of the back side of a semi-twill imprinting fabric having about 20 to about 60 meshes per inch, by having about 20 to about 50 percent of its surface compressed in said dot-dash knuckle pattern such that the long axis of the dash impressions in said pattern is aligned parallel to the machine direction during the formation of said paper sheet, said paper sheet being further characterized by having a cross-directional stretch of from about 3.5 to about 6 percent after creping of said knuckle pattern-imprinted sheet.

4. The soft, bulky and absorbent sheet described in claim 3 which sheet exhibits a diamond-shaped pattern in its surface.

* * * * *

UNITED STATES PATENT AND TRADEMARK OFFICE

CERTIFICATE OF CORRECTION

PATENT NO. : 3,974,025

DATED : August 10, 1976

INVENTOR(S) : Peter G. Ayers

It is certified that error appears in the above-identified patent and that said Letters Patent are hereby corrected as shown below:

Claim 1, column 25, line 21, after "caliper, the" insert -- dot-dash --.

Claim 3, column 26, line 12, after "caliper, the" insert -- dot-dash --.

Signed and Sealed this

Seventh Day of December 1976

[SEAL]

*Attest:*

RUTH C. MASON
*Attesting Officer*

C. MARSHALL DANN
*Commissioner of Patents and Trademarks*